United States Patent [19]

Mangus, Sr.

[11] Patent Number: 4,800,937

[45] Date of Patent: Jan. 31, 1989

[54] LOG SPLITTING APPARATUS

[76] Inventor: Kenneth H. Mangus, Sr., 125 Chestnut St., P.O. Box 22, Manitou Beach, Mich. 49253

[21] Appl. No.: 143,840

[22] Filed: Jan. 14, 1988

[51] Int. Cl.[4] ..... B27L 7/00

[52] U.S. Cl. ..... 144/193 A; 144/190; 144/193 E

[58] Field of Search ..... 144/3 K, 193 R, 193 A, 144/193 E, 366, 190

[56] References Cited

U.S. PATENT DOCUMENTS

| | | | |
|---|---|---|---|
| 4,160,470 | 7/1979 | Sigmund | 144/193 A |
| 4,391,312 | 7/1983 | Sakraida, Jr. | 144/193 E |
| 4,434,825 | 3/1984 | Blomquist | 144/193 A |

FOREIGN PATENT DOCUMENTS

| | | | |
|---|---|---|---|
| 3606194 | 8/1967 | Fed. Rep. of Germany | 144/193 A |

*Primary Examiner*—W. Donald Bray

*Attorney, Agent, or Firm*—Marshall & Melhorn

[57] ABSTRACT

A log splitting apparatus comprising a frame, a main splitting head and a ram means mounted on the frame. The main splitting head includes; a vertically disposed wedge including a beveled leading splitting edge beveled along an angle sloping toward one vertical surface of the wedge and three horizontally disposed wedges attached to one side of the vertically disposed wedge. The horizontal wedges are positioned in such a fashion along the vertical wedge so as to allow a log to be split into a plurality of smaller billets of uniform size without jamming during the splitting process.

9 Claims, 2 Drawing Sheets

LOG SPLITTING APPARATUS

BACKGROUND OF THE INVENTION

Many devices have been used in the past for splitting logs. The most common is the standard wedge which is driven into the log by a sledge hammer or similar device and splits the log into two billets. Variations on the standard wedge have evolved to the point where log splitting machines constructed with power actuated rams, force logs against a splitting wedge or head and divide the log into two or more billets.

With the onset of the energy crisis, many people turned to utilizing wood, as either a supplement or primary fuel source, for heating their homes due to the increased cost for alternative heating fuels. The wood is burned in fireplaces or in a variety of wood burning stoves to generate heat energy. For ease of placing the wood in the stove or fireplace and for a constant burn, it is desirable that the wood be of uniform size. With the increased demand for firewood, and the need for uniformity of size, the need for log splitting machines capable of forming multiple billets of uniform size from a single log has become manifest.

U.S. Pat. No. 4,337,809 discloses a log splitter in which a log is fed along a path of travel for splitting into a plurality of pieces. The log splitter is provided with a splitting mechanism which includes a main splitter arranged with a cutting edge facing the forward end of the log having a straight-sided wedge construction, and a plurality of cutting knives which extend transversely to the main splitter with cutting edges facing the forward end of the log. The cutting knives are spaced apart from one another to define shearing compartments into which the log is fed as it is being split into pieces. U.S. Pat. No. 4,391,312 discloses a log splitting head which may be attached to the main frame of a log splitting machine. The log splitting head is comprised of a baseplate, first and second horizontal cutting plates opposed and spaced from one another and mounted to the baseplate. Each of the horizontal cutting plates includes a cutting edge positioned to receive a log for splitting. A pair of vertically disposed cutting plates with cutting edges positioned to receive a log are mounted in spaced relation between the spaced apart horizontal cutting plates. The baseplate is further constructed with means for securing the baseplate to the main frame of a log splitting machine.

U.S. Pat. No. 4,434,825 discloses a firewood cleaving apparatus comprised of a number of cleaving irons situated in four different consecutive planes. A block of wood is forced down against the cleaving irons with the aid of a ram and step wise split into twelve billets. The cleaving irons in the first two planes split the wood block into four pieces along radial lines. The cleaving iron in the third plane is annular and yields eight pieces, while the irons in the fourth plane are radial and cleave only the radially outer pieces that were separated from the radially inner pieces by the annular cleaving iron.

The log splitters in general use today have several disadvantages. Firstly, they are very cumbersome to operate and are incapable of achieving high production rates. Secondly, the prior art log splitters have a tendency to jam easily due to the type of cutting edges on the cutting wedges used by the devices.

It is an objective of the present invention to produce a log splitting apparatus which is easy to operate and capable of high production rates.

It is a further objective of the present invention to produce a log splitting apparatus which can accommodate logs of varying sizes and split the logs into billets of uniform size.

It is yet another objective of the present invention to produce a log splitting apparatus which will prevent the jamming of the log in the splitting apparatus during the log splitting process.

SUMMARY OF THE INVENTION

The present invention relates to a log splitting apparatus and more particularly to a log splitting apparatus constructed so as to prevent the jamming of the log in the log splitting head during the log splitting process.

The log splitting apparatus in accordance with the present invention is constructed of a generally horizontal frame secured at one end on a horizontally extending axle supported by ground engaging wheels. A hydraulic ram is attached at one end of the horizontal frame and is used to force a log into contact with and through a log splitting head which is attached at the opposite end of the frame.

The log splitting head is comprised of a vertically mounted V-shaped main wedge attached at its base to the frame. The apex of the main wedge is disposed below the centerline of the main wedge and makes the initial contact with the log to be split, thereby providing a pressure point for ease of starting the splitting operation and also tends to force the log downward during the subsequent splitting operation. The log splitting head is further constructed with three generally horizontal superposed spaced apart wedges welded at one end to one surface of the main vertical wedge. The center wedge of the three horizontal wedges is welded at approximately the centerline of the V-shaped vertical main wedge slightly above the apex and is positioned forward of the other two horizontal wedges, thereby engaging the log before the other two horizontal wedges make contact with an associated log. The other two wedges are positioned one above and one below the center most wedge and are welded to the main wedge at equal distances above and below the center wedge. The three horizontal wedges are welded at the other end to a cover plate in such a fashion that, the distance from the center horizontal wedge to the upper and lower horizontal wedges is greater at the cover plate than the distance from the center wedge to the upper and lower wedges at the V-shaped vertical main wedge.

Typically, the operator positions a log on the frame against the hydraulic ram in order to start the splitting process. The hydraulic ram forces the log against the V shaped vertical main wedge making initial contact at the apex thereof. The apex of the main wedge commences the wedging action of the log, thereby splitting the log into two major pieces. One of the pieces then makes contact with the centermost wedge of the three horizontal wedges thereby splitting that piece into two smaller billets. The two smaller billets immediately contact the leading edges of the upper and lower horizontal wedges and are further split into two smaller pieces each. A total of four pieces of firewood is thereby obtained during one stroke of the ram with the present invention.

The major piece of wood split from the original log and not split by the three horizontal wedges is then reinserted on the log splitting apparatus and the process repeated. The process again produces four billets of firewood and can be repeated until the entire log is split.

The disposition of the three horizontal wedges along with the apex of the vertical wedge being below the centerline of the wedge prevents the jamming of the log during the splitting process. Furthermore, the plurality of wedges and their dissimilar locations provides the operator with a compact log splitting apparatus capable of high production rates.

BRIEF DESCRIPTION OF THE DRAWINGS

The above, as well as other advantages of the present invention, will become apparent to one skilled in the art from reading the following detailed description of the invention in conjunction with the attached drawings, in which.

DESCRIPTION OF THE PREFERRED EMBODIMENT

Figure 1:
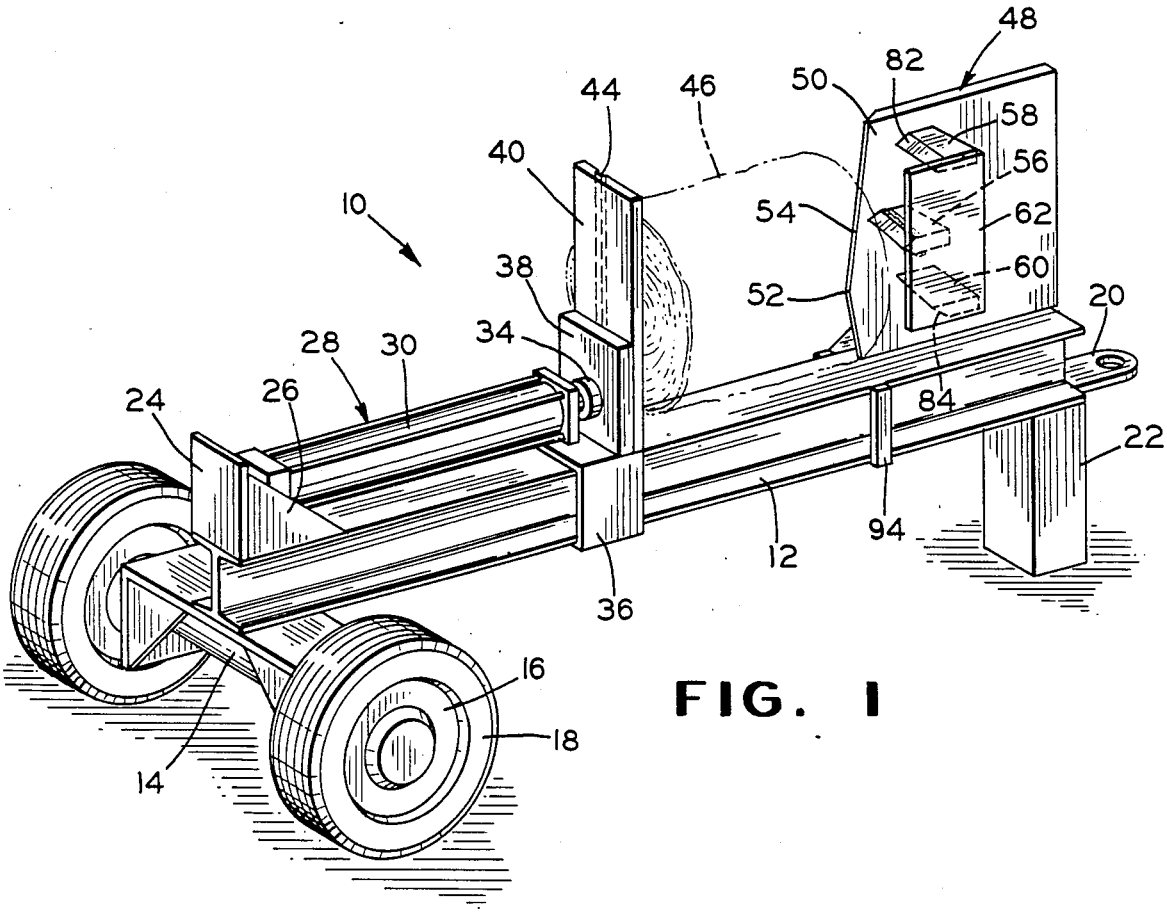
FIG. 1 is a perspective view of a log splitting apparatus in accordance with the present invention.

Referring to FIGS. 1–5, there is illustrated a log splitting apparatus embodying the features of the present invention. In FIG. 1, a log splitting apparatus 10 is shown which includes a frame 12 secured at one end on a horizontally extending axle 14 supported on wheels 16 and associated ground engaging tires 18. The other end of the frame 12 can be provided with a conventional towing hitch 20 for ease of movement of the log splitting apparatus 10. In use, the towing end of the frame 12 is supported on a block 22 or the like with the frame 12 extending generally horizontally as shown in FIG. 1.

A vertically disposed plate 24 is welded to the top of frame 12 in the region of the axle 14 and may be strengthened by at least one gusset 26 which may be welded to the frame 12 and the plate 24. A hydraulic ram means 28, including a cylinder 30, an associated piston rod 32, and a ram head 34 is disposed in a generally horizontal position. One end of the ram means 28 is secured to the plate 24 by welding or a plurality of fasteners, for example. The ram head 34 is guided for to and fro movement along the frame 12 by means of a base 36 slidably mounted to the frame 12. A plate 38 has one surface attached to the ram head 34 and the opposite surface attached to a push plate 40. The push plate 40 is constructed with a vertically extending groove 44 on the surface which is opposite the surface attached to the plate 38.

The push plate 40 is used to force a log 46 into and through a log splitting head 48 when the piston rod 32 is caused to extend from the cylinder 30, thereby causing the ram head 34 to move toward the splitting head 48. Thus, as piston rod 32 is caused to extend from the cylinder 30, ram head 34 and associated push plate 40 are moved toward the log splitting head 48 and will drive the log 46 into and through the log splitting head 48 as the ram head 34 continues to so move. During this movement, the log splitting action as will be described hereafter, takes place. The above described mechanisms function as means for feeding a log 46 along a path of travel in which the log 46 is split into a plurality of billets.

The log splitting head 48 comprises a vertically disposed main splitting wedge 50 constructed with an apex 52 typically disposed below the centerline of the wedge 50. The leading edge 54 of the wedge 50 is formed to have a chisel shaped edge, whereby one side of the edge 54 has a steeper margin 54′ than the margin 54″ of the other side of edge 54 as is clearly illustrated in FIG. 2. The log splitting head 48 further includes three superposed spaced apart generally horizontal wedges 56, 58, and 60 projecting from one side of the main wedge 50 and having one end welded thereto with the opposite ends welded to a cover plate 62. The horizontal wedge 56 is mounted slightly above the apex 52 of the main wedge 50. The upper horizontal wedge 58 and the lower horizontal wedge 60 are welded onto the main wedge 50 at substantially equal distances above and below, respectively, of the center horizontal wedge 56. The upper and lower wedges 58 and 60, respectively, are also positioned behind the center wedge 56 so as to allow the center wedge 56 to engage the log to be split prior to the upper and lower wedges 58 and 60 contacting the log 46.

Figure 2:
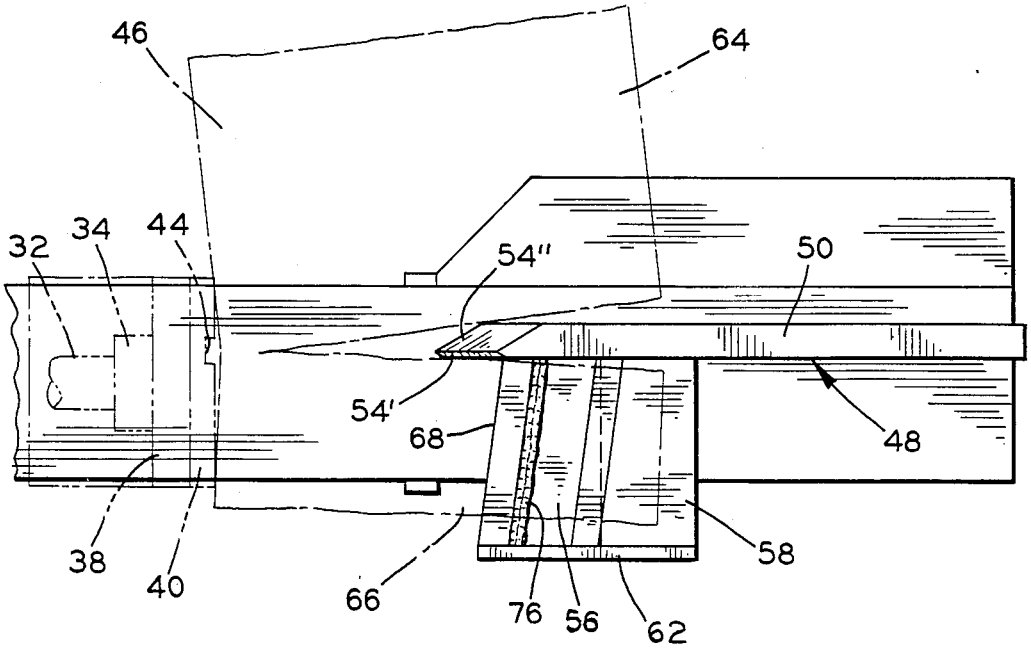
FIG. 2 is a fragmentary top view showing the log splitting head and the hydraulic ram of the apparatus illustrated in FIG. 1.
Figure 3:
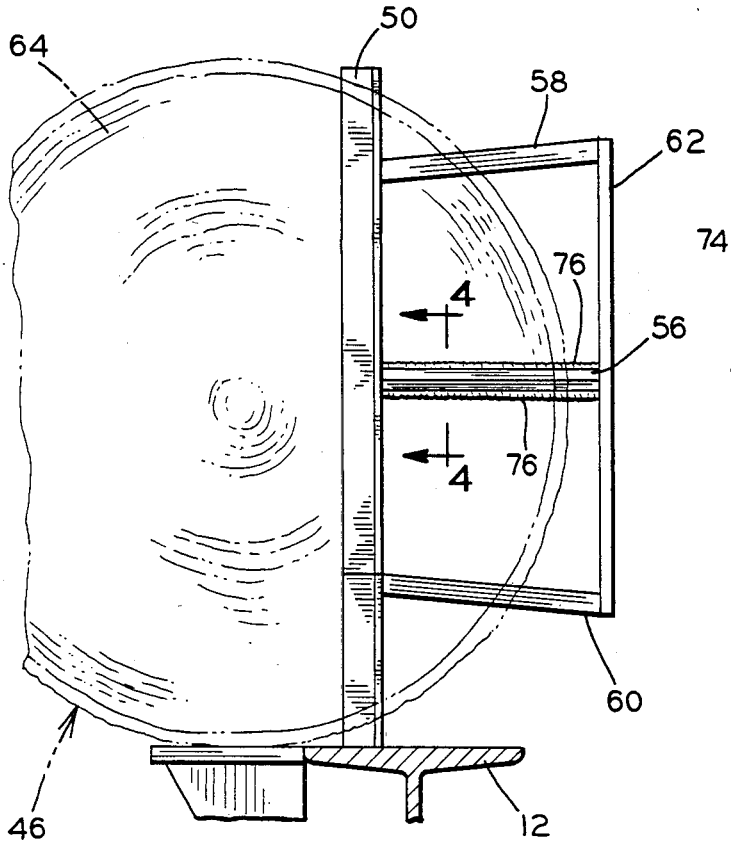
FIG. 3 is a fragmentary vertical sectional view of the log splitting head illustrated in FIG. 1.

In operation, the cylinder 30 is actuated to fully retract the piston rod 32 and the associated push plate 40. Then a log 46 is placed on the frame 12 at a location between the push plate 40 and the log splitting head 48. The log 46 is forced into the log splitting head 48 by operation of the hydraulic ram means 28 which extends the piston rod 32 thereby moving ram head 34 and the associated push plate 40. As the log 46 is moved toward the log splitting head 48, its forward end initially contacts the leading edge 54 of the main wedge 50 at the apex 52. The apex 52 of the main wedge 50 provides a pressure point on the log 46 thereby increasing the ease of the initial splitting of the log 46. Also, it will be noted that the upper portion of leading edge 54 shapes away from the apex 52 at a greater angle from the vertical than the angle which the lower portion of leading edge 54 slopes away from the vertical. Such a relationship effectively causes the main wedge 50 to continuously tend to apply a downwardly acting force vector on the log 46 as it is forced by the push plate 40 through the splitting head 48. The downwardly acting force tends to maintain the transient log 46 on the frame 12 and militates against any undesired upward movement thereof. Continued travel of the log 46 into the main wedge 50 will result in the log 46 being split into two pieces by the action of the chisel-shaped leading edge 54. As shown in FIG. 2, the first piece 64 of log 46 will be discarded from the splitting process, while the second piece 66 of log 46 will continue advancing thereby coming into contact with the edge 68 of the center horizontal wedge 56.

Figure 4:
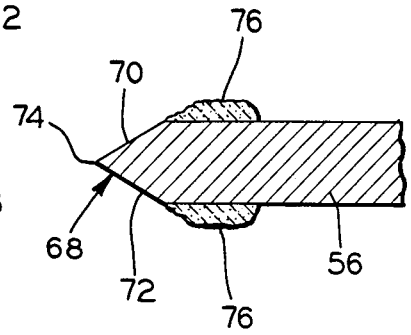
FIG. 4 is a fragmentary sectional view of the leading edge of the center horizontal wedge taken along line 4—4 of FIG. 3.
Figure 5:
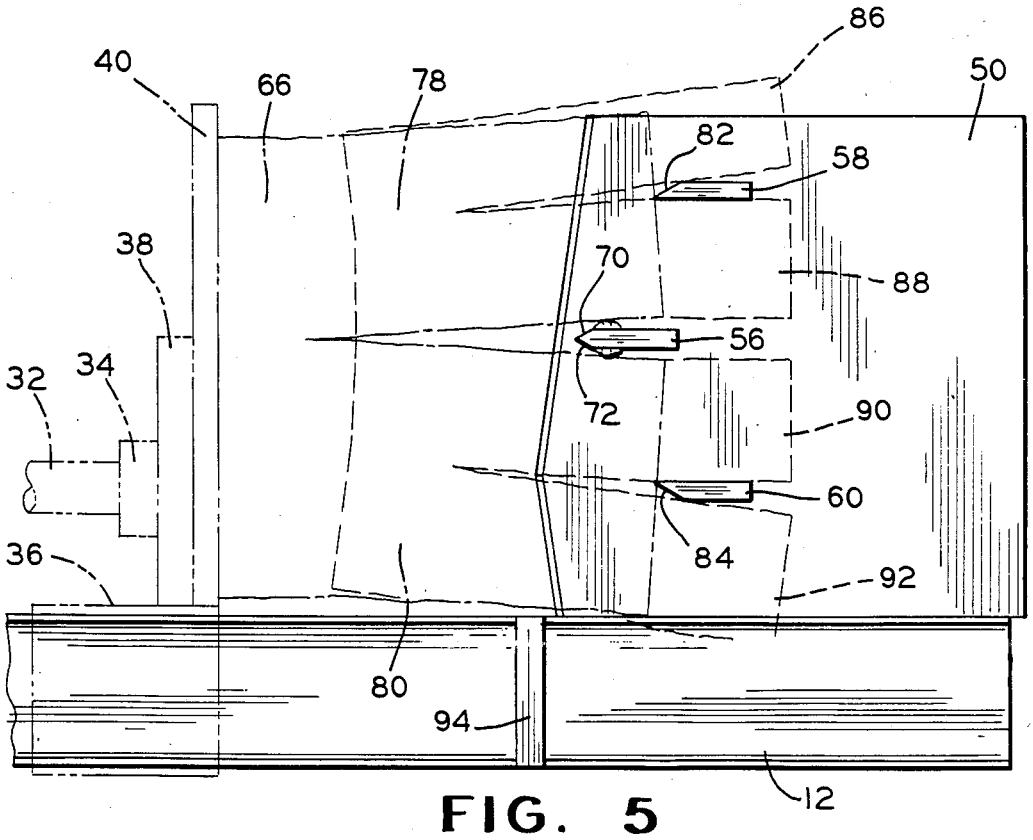
FIG. 5 is an enlarged fragmentary elevational view of the log splitting head illustrated in FIG. 1.

The edge 68 of the center horizontal wedge 56 is comprised with substantially symmetrical margins 70 and 72 converging into a zenith 74, as shown in FIG. 4. The edge 68 of the center horizontal wedge 56 is further constructed with a buildup of weld bead 76 disposed along the entire length of the trailing edge of the margins 70 and 72.

The piece of log 66, is split into two pieces 78 and 80 as it is advanced into the edge 68 of the horizontal wedge 56 through the continued extension of the piston rod 32 of the hydraulic ram means 28. As the piece of log 66 is split into two smaller pieces 78 and 80 by the edge 68 of the center horizontal wedge 56, the bead of weld 76, acting as a wedge, further expands the width of the split. The smaller pieces of log 78 and 80 are forced upwardly and downwardly, respectively, during their advancement by the weld bead 76 into horizontal wedges 58 and 60.

The horizontal wedges 58 and 60 are configured differently from the center horizontal wedge 56, in that the edges 82 and 84, respectively, are formed by a straight-sided wedge construction. This type of construction forms the zenith of the edge at the converging point of the margin and the straight side of the wedge.

As the two pieces of log 78 and 80 are forced into the horizontal wedges 58 and 60, they are split into four smaller billets 86, 88, 90 and 92. It will be appreciated that in accordance with a principle feature of the present invention, the width of billets 86. 88, 90 and 92 is caused to be less than the distance between the horizontal wedges 56, 58 and 60. This difference in width is due to the construction and positioning of the upper and lower wedges 58 and 60 in cooperation with and relative to the construction and positioning of the center horizontal wedge 56. The use of the weld bead 76 on the center wedge 56 forces the pieces of log 78 and 80 into a steeper contact angle with the upper and lower horizontal wedges 58 and 60. This steeper angle decreases the width of the billets 86, 88, 90 and 92 relative to the width between the horizontal wedges 56, 58 and 60, thereby eliminating interference contact. The design of the log splitting head 48 militates against interference between the billets and the wedges to prevent the jamming of the billets between the associated horizontal wedges thereby allowing high production rates.

As the piston rod 32 extends, it forces the sliding base 36 toward the leading edge 54 of the main wedge 50. Prior to the push plate 40 engaging the main wedge 50, the sliding base 36 contacts a positive stop member 94, thereby preventing any additional forward movement of the push plate 40 toward the main wedge 50 of the log splitting head 48. Furthermore, the vertical groove 44 in the push plate 40 allows the leading edge 54 of the main wedge 50 to range into the push plate 40, thereby permitting the log 46 to be completely split and still provide a relief into which the main wedge 50 can extend without making contact. At the completion of one stroke of the hydraulic ram means 28, the log 46 is split into five pieces, four of which are of relatively uniform billets of the size required for fireplace and stove use. The other piece of the log 46 is then again positioned on the frame 12 at a location between the push plate 40 and the log splitting head 48 and the process repeated.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A log splitting apparatus comprising:

a frame;

a main splitter mounted on said frame, said main splitter including;

a vertically disposed wedge having a leading splitting edge bevelled along an angle sloping toward one vertical surface of said vertically disposed wedge, the leading splitting edge of the vertically disposed wedge having a leading apex with an upper portion sloping rearwardly from said apex at a first angle from the vertical and a lower portion sloping rearwardly from said apex at a second angle from the vertical, the first angle being greater than the second angle;

a first horizontally disposed wedge extending from the opposite vertical surface of said vertically disposed wedge and having a splitting edge having two bevelled surfaces extending in opposite directions, said apex of the leading splitting edge of the vertically disposed wedge residing in a plane below the plane of the splitting edge of said first horizontally disposed wedge;

a second horizontally disposed wedge extending from said opposite vertical surface of said vertically disposed wedge and spaced from said first horizontally disposed wedge and including a splitting edge having a bevelled edge sloping away from said first horizontally disposed wedge;

a third horizontally disposed wedge extending from said opposite vertical surface of said vertically disposed wedge and spaced from an opposite side of said first horizontally disposed wedge and including a splitting edge having a bevelled edge sloping away from said first horizontally disposed wedge; and ram means mounted on said frame for to and fro movement relative to said main splitter.

2. The invention defined in claim 1, wherein said first horizontally disposed wedge comprises a plate member, said two bevelled surfaces being formed on the leading edge of said plate member to define said splitting edge, and said plate member including an area of increased thickness extending along and behind said bevelled edge.

3. The invention defined in claim 1, wherein the splitting edge of the vertically disposed wedge of said main splitter is disposed in advance of the splitting edges of the horizontally disposed wedges of said main splitter.

4. The invention defined in claim 3, wherein the splitting edge of the first horizontally disposed wedge is disposed in advance of the second and third horizontally disposed wedges.

5. The invention defined in claim 1, wherein the distal ends of the first, second, and third horizontally disposed wedges are affixed to a vertically extending plate member.

6. The invention defined in claim 1, wherein the distal end of the first and second horizontally disposed wedges, and the first and third horizontally disposed edges are spaced a greater distance apart than the respective proximal ends.

7. The invention defined in claim 1, wherein said ram means includes a push plate.

8. The invention defined in claim 7, wherein said push plate includes a vertically extending groove.

9. The invention in claim 8 including means for preventing movement of said vertically disposed wedge into contact with the groove in said push plate.

* * * * *